US005933170A

United States Patent [19]

Takeuchi et al.

[11] Patent Number: 5,933,170

[45] **Date of Patent: *Aug. 3, 1999**

[54] INK JET PRINT HEAD

[75] Inventors: Yukihisa Takeuchi, Aichi-ken; Hideo Masumori, Anjo; Nobuo Takahashi, Owariasahi; Hideaki Sonehara, Suwa; Kohei Kitahara, Shiojiri, all of Japan

[73] Assignees: NGK Insulators, Ltd.; Seiko Epson Corporation, both of Japan

[ * ] Notice: This patent is subject to a terminal disclaimer.

[21] Appl. No.: 08/735,445

[22] Filed: Jan. 2, 1997

Related U.S. Application Data

[63] Continuation of application No. 08/066,193, May 25, 1993, abandoned.

[30] Foreign Application Priority Data

May 27, 1992 [JP] Japan ..... 4-160204
Mar. 22, 1993 [JP] Japan ..... 5-087996

[51] Int. Cl.[6] ..... B41J 2/045

[52] U.S. Cl. ..... 347/71

[58] Field of Search ..... 347/68–71; 310/330, 310/365

[56] References Cited

U.S. PATENT DOCUMENTS

| | | | |
|---|---|---|---|
| 3,747,120 | 7/1973 | Stemme | 346/75 |
| 3,946,398 | 3/1976 | Kyser et al. | 346/75 |
| 4,680,595 | 7/1987 | Cruz-Uribe et al. | 346/140 R |
| 4,695,854 | 9/1987 | Cruz-Uribe | 346/140 R |
| 4,766,671 | 8/1988 | Utsumi et al. | 29/848 |
| 4,937,597 | 6/1990 | Yasuhara et al. | 346/140 R |
| 5,126,615 | 6/1992 | Takeuchi et al. | 310/328 X |
| 5,359,354 | 10/1994 | Hiraishi et al. | 347/94 X |
| 5,376,856 | 12/1994 | Takeuchi et al. | 310/328 |
| 5,475,279 | 12/1995 | Takeuchi et al. | 310/328 X |

FOREIGN PATENT DOCUMENTS

| | | | |
|---|---|---|---|
| 0426473 | 5/1991 | European Pat. Off. | B41J 2/14 |
| 0443628 | 8/1991 | European Pat. Off. . | |
| 3628346 | 2/1988 | Germany | B41J 3/04 |
| 58-116163 | 7/1983 | Japan | B41J 3/04 |
| 60-232967 | 11/1985 | Japan | B41J 3/04 |
| 62-101455 | 5/1987 | Japan | B41J 3/04 |
| 62-213399 | 9/1987 | Japan . | |
| 63-149159 | 6/1988 | Japan | B41J 3/04 |
| 3-128681 | 5/1991 | Japan . | |
| WO 89/07752 | 8/1989 | WIPO | G01D 15/16 |

*Primary Examiner*—Benjamin R. Fuller
*Assistant Examiner*—Craig A. Hallacher
*Attorney, Agent, or Firm*—Parkhurst & Wendel, L.L.P.

[57] ABSTRACT

An ink jet print head is disclosed which includes an ink nozzle member with nozzles, an ink pump member disposed on the ink nozzle member and having ink chambers formed behind the respective nozzles, and piezoelectric/electrostrictive elements each disposed on a wall defining the corresponding ink chamber, for deforming the wall to change a pressure of the ink chamber, whereby the ink in the ink chamber is jetted through the corresponding nozzle. The ink pump member consists of a spacer plate having windows which are closed by a closure plate and a connecting plate disposed on the spacer plate, so as to give the respective ink chambers. The connecting plate has communication holes through which the ink chambers communicate with the nozzles. The spacer plate, closure plate and connecting plate are formed from respective ceramic green sheets, which are laminated on each other and fired into an integral ceramic structure as the ink pump member. The piezoelectric/electrostrictive element includes a pair of electrodes and a piezoelectric/electrostrictive layer, which are formed by a film-forming method on an outer surface of the closure plate.

18 Claims, 5 Drawing Sheets

INK JET PRINT HEAD

This is a Continuation of application Ser. No. 08/066,193 filed May 25, 1993, now abandoned.

BACKGROUND OF THE INVENTION

1. Field of the Invention

The present invention relates in general to an ink jet print head, and more particularly to such an ink jet print head which has a novel structure that assures improved and stable ink-jetting characteristics or capability, and which is available at a reduced cost.

2. Discussion of the Prior Art

In the recent market of printers used as an output device of a computer or others, there is a rapidly increasing demand for an ink jet printer which operates quietly at a relatively low cost. The ink jet printer includes an ink jet print head which is generally adapted to raise the pressure in an ink chamber filled with a mass of ink, to thereby jet or discharge fine ink particles from nozzles so as to effect printing.

There is known one type of the ink jet print head which has a piezoelectric/electrostrictive element disposed on a wall of the ink chamber, as means for raising the pressure in the ink chamber as described above. In this type of print head, a volume of the ink chamber is changed upon energization and displacement of the piezoelectric/electrostrictive element. The ink jet print head of this type is advantageous in reduced consumption of electric power, as compared with another type of ink jet print head which is adapted to heat the ink by a heater disposed in the ink chamber, to generate minute bubbles used for jetting the fine ink particles.

Referring to FIGS. 5 and 6 showing an example of the above type of the ink jet print head, a metallic nozzle plate 4 having a plurality of nozzles 2, a metallic orifice plate 8 having a plurality of orifices 6, and a channel plate 10 are superposed on each other such that the channel plate 10 is interposed between the plates 4, 8, and these plates 4, 8, 10 are bonded together into an ink nozzle member 16. In this ink nozzle member 16, there are formed a plurality of ink discharge channels 12 for leading or guiding an ink material to the respective nozzles 2, and at least one ink supply channel 14 for leading or supplying the ink material to the orifices 6. The ink jet print head further includes an ink pump member 24 which consists of two plates 18, 20 made of metal or synthetic resin and formed in lamination on the ink nozzle member 16. The ink pump member 24 has a plurality of voids 22 which correspond to the nozzles 2 and orifices 6. With this ink pump member 24 superposed on and bonded to the ink nozzle member 16, each of the voids 22 provides an ink chamber 26 formed behind the corresponding nozzle and orifice 2, 6. The ink jet print head also includes a plurality of piezoelectric/electrostrictive elements 28 each of which is secured to a wall of the corresponding ink chamber 26 remote from the ink nozzle member 16.

In producing the above type of ink jet print head, however, small pieces of the piezoelectric/electrostrictive elements 28 must be bonded to the walls of the respective ink chambers 26, which makes it extremely difficult to render the resulting print head sufficiently small-sized. Further, the bonding of the piezoelectric/electrostrictive elements 28 inevitably pushes up the cost of manufacture of the print head, and makes it difficult for the elements 28 to maintain sufficiently high reliability.

In the production of the above-described ink jet print head, another problem arises when the ink nozzle member 16 and the ink pump member 24 are bonded together. Namely, the spacing between the adjacent voids 22, 22 formed in the print head, that is, the thickness "t" of a partition wall 30 which separates the adjacent voids from each other, is considerably small, more precisely, about 1 mm or smaller. Such a small spacing between the voids 22 makes it extremely difficult to bond the ink nozzle member 16 and the ink pump member 24 to each other.

More specifically, an adhesive used for bonding the ink nozzle member 16 and the ink pump member 24 is likely to overflow onto the opposite surfaces of the partition wall 30. Therefore, the ink chambers 26 and/or ink flow channels including the ink supply and discharge channels 12, 14 and orifices 6 may be deformed, whereby the ink-jetting characteristics of the print head may deteriorate, resulting in reduced quality and yield of the products (print heads).

If the amount of the adhesive applied is reduced to avoid its overflow as described above, it is likely that the ink nozzle member 16 and ink pump member 24 are insufficiently or poorly bonded together at some portions of the interface of the members 16, 24. This may result in incomplete sealing between the adjacent ink chambers 26, 26, causing leakage of the pressures of the ink chambers 26, 26 and consequent crosstalk, for example. The partial or insufficient bonding may also leave gaps between the bonding surfaces of the members 16, 24, resulting in pressure loss upon pressurizing of the ink chambers 26 due to the air remaining in the gaps. Consequently, the ink-jetting characteristics of the print head may be lowered.

SUMMARY OF THE INVENTION

It is therefore an object of the present invention to provide an ink jet print head in which an ink nozzle member and an ink pump member can be easily bonded to each other, to alleviate or eliminate the above problems due to incomplete bonding of the members or overflow of an adhesive from their bonding surfaces, thereby assuring excellent ink-jetting characteristics with high stability. It is also an object of the invention to provide such an ink jet print head which can be easily produced with improved efficiency, and which is sufficiently small-sized.

The above object may be accomplished according to the principle of the present invention, which provides an ink jet print head comprising: an ink nozzle member having a plurality of nozzles through which fine particles of an ink are jetted; an ink pump member disposed on and bonded to the ink nozzle member, the ink pump member having a plurality of ink chambers formed behind the respective nozzles of the ink nozzle member, the ink pump member consisting of a spacer plate having a plurality of windows which provide the ink chambers, respectively, a closure plate disposed on one of opposite major surfaces of the spacer plate remote from the ink nozzle member, for closing one of opposite openings of each of the windows, and a connecting plate disposed on the other major surface of the spacer plate, for closing the other opening of each window, the connecting plate having a plurality of first communication holes located behind the respective nozzles of the ink nozzle member, for communicating the ink chambers with the respective nozzles, the spacer plate, the closure plate and the connecting plate being formed from respective ceramic green sheets which are laminated on each other and fired into an integral ceramic structure as the ink pump member; and a plurality of piezoelectric/electrostrictive elements each disposed on a wall partially defining the corresponding one of the ink chambers, for deforming the wall so as to change a pressure of the corresponding ink chamber, whereby the ink in the ink chamber is jetted through the corresponding one of the plurality of nozzles, each of the piezoelectric/electrostrictive elements comprising a piezoelectric/electrostrictive portion consisting of a pair of electrodes and a piezoelectric/electrostrictive layer, which are formed by a film-forming method on an outer surface of the closure plate of the ink pump member, such that the piezoelectric/electrostrictive layer is interposed between the pair of electrodes.

In the ink jet print head constructed according to the present invention, an ink flow channel through which the ink flows through the print head is provided with a remarkably improved seal at an interface between the ink pump member and the ink nozzle member. This leads to an effectively improved and stable quality of the print heads produced.

Further, according to the present invention, the piezoelectric/electrostrictive elements can be easily formed by a film-forming method with considerably high efficiency. Therefore, the present print head can be produced with further improved quality and improved production efficiency, while permitting reduction of the size thereof.

In a preferred form of the present invention, the ink nozzle member has an ink supply channel through which the ink is fed to the ink chambers of the ink pump member, and a plurality of orifices for guiding the ink from the ink supply channel to the respective ink chambers. The orifices are open on an outer surface of the ink nozzle member on which the ink pump member is superposed. Further, the connecting plate of the ink pump member has a plurality of second communication holes located adjacent the respective orifices of the ink nozzle member, for communicating the ink chambers with the respective orifices.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
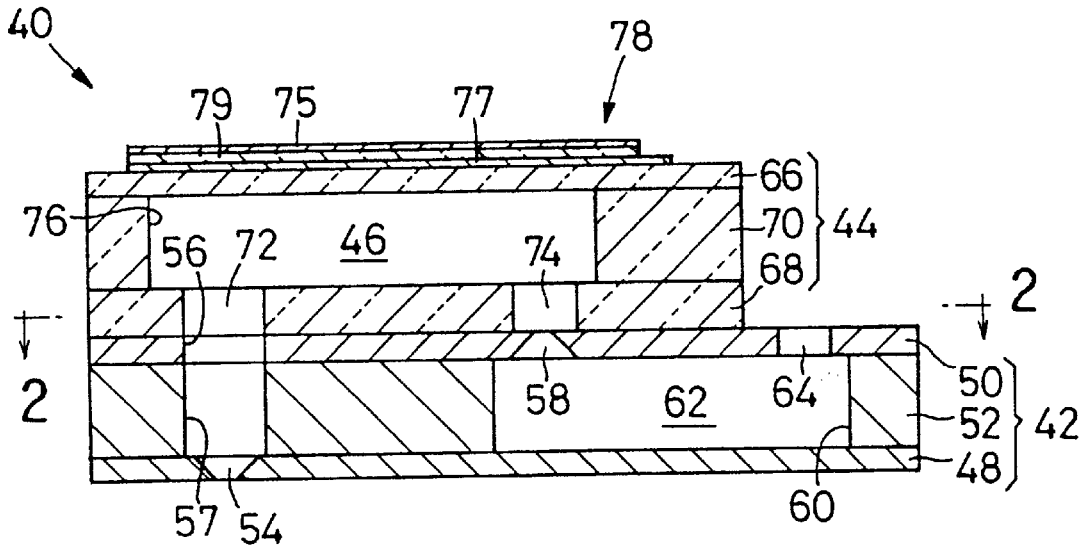
FIG. 1 is a vertical cross sectional view showing one embodiment of an ink jet print head of the present invention.
Figure 2:
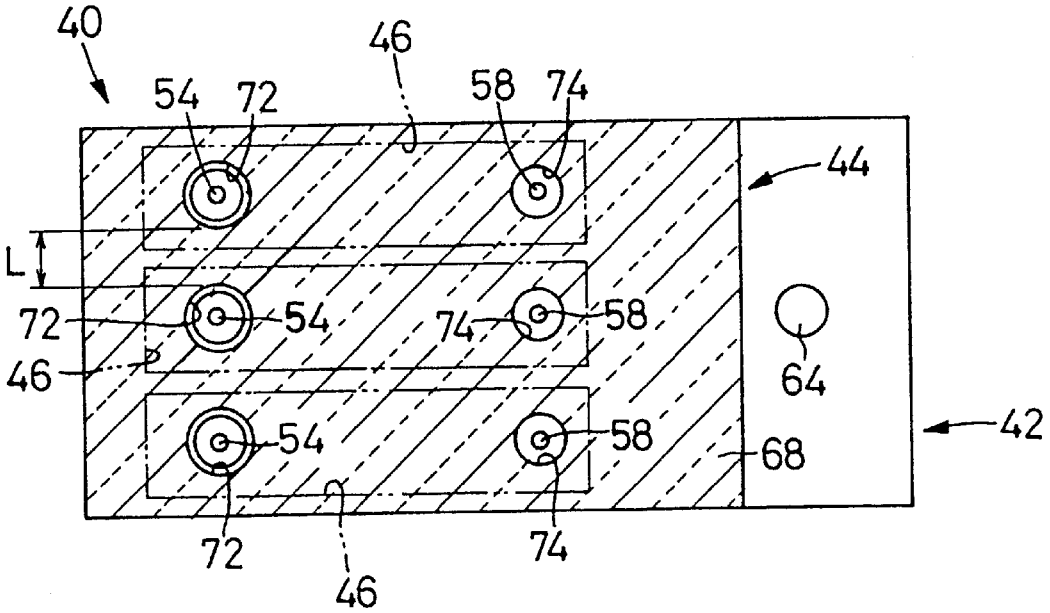
FIG. 2 is a cross sectional view taken along line 2—2 of FIG. 1.
Figure 3:
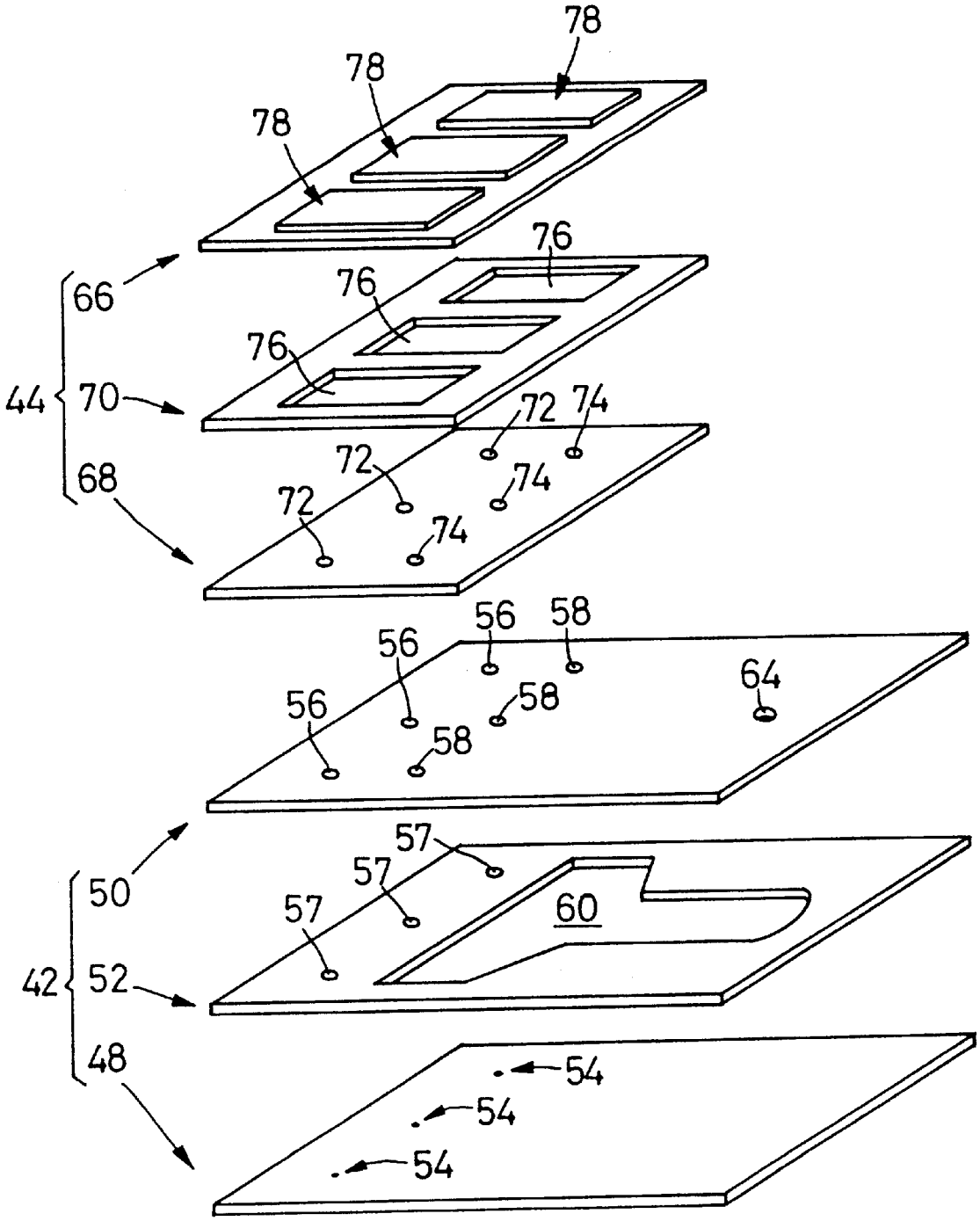
FIG. 3 is an exploded perspective view explaining the construction of the ink jet print head of FIG. 1.

Referring to FIGS. 1 and 2 schematically showing an ink jet print head 40 as one preferred embodiment of the present invention, and to FIG. 3 which is an exploded perspective view of the print head 40, an ink nozzle member 42 and an ink pump member 44 are bonded together to form an integral structure of the ink jet print head 40. In this print head 40, an ink material is supplied to a plurality of ink chambers 46 formed in the ink pump member 44, and is jetted or discharged from a plurality of nozzles 54 formed through the ink nozzle member 42.

More specifically, the ink nozzle member 42 consists of a nozzle plate 48 and an orifice plate 50 having a relatively small thickness, and a channel plate 52 interposed between these plates 48, 50. The nozzle plate 48 and the orifice plate 50 are integrally bonded to the channel plate 52 by means of an adhesive.

The nozzle plate 48 has a plurality of nozzles 54 (three in this embodiment) formed therethrough, for permitting jets of fine ink particles, while the orifice plate 50 and the channel plate 52 have respective through-holes 56, 57 formed through the thicknesses thereof. These through-holes 56, 57 are aligned with the respective nozzles 54 as viewed in the direction of the thickness of the plates 48, 50, 52, and have a diameter which is larger by a given value than that of the nozzles 54.

The orifice plate 50 further has a plurality of orifices 58 (three in this embodiment) formed therethrough, for permitting flow of the ink into to the respective ink chambers 46. The channel plate 52 is formed with a window 60 which is closed at its opposite openings by the nozzle plate 48 and orifice plate 50, respectively, whereby an ink supply channel 62 communicating with the orifices 58 is defined by the channel plate 52, the nozzle plate 48 and the orifice plate 50. The orifice plate 50 further has a supply port 64 through which the ink is fed from an ink reservoir into the ink supply channel 62.

While the material used for the plates 48, 50, 52 of the ink nozzle member 42 is not particularly limited, these plates 48, 50, 52 are preferably made of a plastic, or a metal such as nickel or stainless steel, which enables the nozzles 54 and orifices 58 to be formed in the respective plates 48, 50 with high accuracy. Each of the orifices 58 is desirably formed in tapered shape such that the diameter of the orifice 58 is reduced in the direction of flow of the ink (i.e., the direction from the ink supply channel 62 toward the ink chambers 46), as shown in FIG. 1 by way of example, so as to function as a check valve for inhibiting the ink from flowing in the reverse direction.

The ink pump member 44 consists of a closure plate 66 and a connecting plate 68 having a relatively small thickness, and a spacer plate 70 interposed between these plates 66, 68. These plates 66, 68, 70 are superposed on each other and formed integrally into the ink pump member 44 in a manner as described later.

The connecting plate 68 has first communication holes 72 and second communication holes 74 formed therethrough, which are respectively aligned with the through-holes 56 and orifices 58 formed in the orifice plate 50, as viewed in the direction of thickness of the plates 68, 50. The diameter of the first communication holes 72 is substantially equal to or slightly larger than that of the through-holes 56, while the diameter of the second communication holes 74 is larger by a given value than that of the orifices 58.

The spacer plate 70 has a plurality of rectangular windows 76 formed therethrough. The spacer plate 70 is superposed on the connecting plate 68 such that each of the windows 76 communicates with the corresponding first and second communication holes 72, 74 formed in the connecting plate 68.

On one of the opposite major surfaces of the spacer plate 70 remote from the connecting plate 68 is superposed on the above-indicated closure plate 66 for closing openings of the windows 76. In this arrangement, the ink chambers 46 are formed within the ink pump member 44, such that the chambers 46 communicate with an exterior space through the first and second communication holes 72, 74.

The ink pump member 44 is formed as an integrally formed fired ceramic structure. That is, in the process of producing the ink pump member 44, green sheets are initially formed by using a slurry that is prepared from ceramic materials, binders, liquid solvents and others, by means of a generally used device such as a doctor blade device or a reverse roll coater. Then, the green sheets are subjected to suitable processing such as cutting, machining or punching, as needed, so as to form the windows 76 and the first and second communication holes 72, 74. Thus, there are formed precursors for the plates 66, 68, 70. These precursors are then laminated on each other and fired into an integral ceramic body as the ink pump member 44.

While the ceramic material used for forming the ink pump member 44 is not particularly limited, alumina, zirconia or the like may be favorably employed in view of its formability and other properties. The closure plate 66 preferably has a thickness of 50 μm or smaller, more preferably, within a range of about 3 to 12 μm. The connecting plate 68 preferably has a thickness of 10 μm or larger, more preferably, 50 μm or larger. The spacer plate 70 preferably has a thickness of 50 μm or larger, more preferably, 100 μm or larger.

The above-described ink pump member 44, which is formed as an integral fired ceramic structure, does not require any particular adhesive treatment for bonding the plates 66, 68, 70 together. Accordingly, complete and secure sealing can be achieved at the interfaces between the closure plate 66 and spacer plate 70 and between the connecting plate 68 and spacer plate 70.

In addition, the ink pump member 44 can be produced with improved efficiency, due to the presence of the connecting plate 68. Namely, it is generally difficult to handle a laminar structure consisting of thin, flexible green sheets, and fracture of the laminar structure and abnormal deformation of a resultant fired body tend to occur due to strains induced in the laminar structure when it is inadvertently supported upon its setting on a furnace. In the instant embodiment, however, the laminar structure including the connecting plate 68 exhibits an enhanced rigidity due to the presence of the plate 68, assuring improved handling ease thereof, while reducing the possibility of occurrence of defects due to handling failure, as compared with when the structure does not include the connecting plate 68. Further, it is normally impossible to handle a laminar structure consisting only of the closure plate 66 and spacer plate 70 where the ink chambers 46 are formed with high density in the ink pump member 44, that is, where the ink pump member 44 includes a comparatively large number of ink chambers 46. In the instant embodiment, however, the connecting plate 68 makes it possible to handle the laminar structure even in the above-described situation.

While the configuration of the ink pump member 44 varies depending upon various factors relating to production of this member 44, it is desirable that the surface of the ink pump member 44 which is to be bonded to the ink nozzle member 42, that is, the outer surface of the connecting plate 68, is made even or smooth. The evenness of the relevant surface of the ink pump member 44 is suitably controlled so that the surface has the maximum waviness of not larger than 50 μm as measured along a reference length of 8 mm, by means of a roughness measuring system. Desirably, the maximum waviness of the relevant surface is not larger than 25 μm, more desirably, not larger than 10 μm. As a means for achieving the above degree of surface evenness, the fired ceramic body which gives the ink pump member 44 may be subjected to machining such as lapping or surface grinding.

On the ink pump member 44, more precisely, on the outer surface of the closure plate 66, there are formed piezoelectric/electrostrictive elements 78 which correspond to the respective ink chambers 46 formed in the member 44. Each of the piezoelectric/electrostrictive elements 78 has a piezoelectric/electrostrictive unit consisting of a lower electrode 77, a piezoelectric/electrostrictive layer 79, and an upper electrode 75, which are formed in lamination on the closure plate 66, by a suitable film-forming method. As the piezoelectric/electrostrictive element 78 of the instant embodiment, it is particularly preferable to employ a piezoelectric/electrostrictive element as proposed in co-pending U.S. patent application No. 07/912,920 assigned to the same assignee as the present patent application.

More specifically, the closure plate 66, which serves as a substrate for the piezoelectric/electrostrictive elements 78, is suitably formed by a ceramic substrate made of a material whose major component is zirconia having a crystal phase that is partially or fully stabilized by a suitable compound or compounds. The term "partially or fully stabilized zirconia" used herein should be interpreted to mean zirconia whose crystal phase is partially or fully stabilized, so that the crystal phase partially undergoes or does not undergo phase transformations, respectively, upon application of heat, stress or the like thereto.

The above-indicated compound or compounds for stabilizing the zirconia is selected from the group consisting of: yttrium oxide; cerium oxide; magnesium oxide; and calcium oxide. The zirconia is partially or fully stabilized as desired, by addition of at least one of these compounds, that is, a selected one of the above-indicated oxides or a selected combination of two or more of these oxides. It is desirable to stabilize the zirconia by adding 2 to 7 mole % of yttrium oxide, or 6 to 15 mole % of cerium oxide, or 5 to 12 mole % of magnesium oxide or calcium oxide. It is particularly recommended to use yttrium oxide in an amount of 2 to 7 mole %, more preferably, 2 to 4 mole %, so as to partially stabilize the zirconia. With the addition of the yttrium oxide in the above range, the zirconia has a primary crystal phase which is partially stabilized as a tetragonal phase or a combination of a cubic phase and the tetragonal phase, to provide the ceramic substrate (closure plate 66) having excellent properties. Further, the average crystal grain size of the ceramic substrate is preferably controlled to within a range of 0.05 μm–2 μm, more preferably, to 1 μm or smaller, so as to ensure the presence of the tetragonal phase and assure a sufficiently large mechanical strength of the ceramic substrate.

On the outer surface of the closure plate 66 are formed suitable films of the upper and lower electrodes 75, 77 and the piezoelectric/electrostrictive layers 79, by any one of various known methods which include thick-film forming process such as screen printing, spraying, dipping and coating, and thin-film forming process such as ion-beam method, sputtering, vacuum vapor deposition, ion plating, CVD and plating. These layers 75, 77, 79 may be formed either before or after firing of the closure plate 66 (the ink pump member 44). Then, the electrode films 75, 77 and piezoelectric/electrostrictive layer 79 thus formed on the closure plate 66 may be heat-treated as needed, either in different steps following formation of the respective layers 75, 77, 79, or in one step following formation of all of the layer 75, 77, 79. To assure improved reliability of insulation between the electrode films 75, 77, there may be formed as needed an insulating resin layer between the adjacent piezoelectric/electrostrictive layers 79, 79.

The electrode films 75, 77 of each piezoelectric/electrostrictive unit may be formed of any electrically conductive material which can withstand a high-temperature oxidizing atmosphere generated upon the heat-treatment or firing as described above. For instance, the electrode films 75, 77 may be formed of a single metal, an alloy of metals, a mixture of a metal or alloy and an electrically insulating ceramic or glass, or an electrically conductive ceramic. Preferably, the electrode material has as a major component a noble metal having a high melting point, such as platinum, palladium or rhodium, or an alloy such as silver-palladium alloy, silver-platinum alloy or platinum-palladium alloy.

The piezoelectric/electrostrictive layer 79 of each piezoelectric/electrostrictive unit may be formed of any piezoelectric or electrostrictive material which produces a relatively large amount of strain or displacement due to the converse or reverse piezoelectric effect or the electrostrictive effect. The piezoelectric/electrostrictive material may be either a crystalline material or an amorphous material, and may be a semi-conductor material or a dielectric or ferroelectric ceramic material. Further, the piezoelectric/electrostrictive material may either require a treatment for initial polarization or poling, or may not require such a polarization treatment.

The piezoelectric/electrostrictive material used for the piezoelectric/electrostrictive layer 79 preferably contains as a major component lead zirconate titanate (PZT), lead magnesium niobate (PMN), lead nickel niobate (PNN), lead manganese niobate, lead antimony stannate, lead zinc niobate, lead titanate, or a mixture thereof. The piezoelectric/electrostrictive material having the above major component may further contain as an additive an oxide or other compound of lanthanum, barium, niobium, zinc, cerium, cadnium, chromium, cobalt, strontium, antimony, iron, yttrium, tantalum, tungsten, nickel, and/or manganese, so as to provide a material containing PLZT, for example.

The piezoelectric/electrostrictive unit consisting of the electrode films 75, 77 and the piezoelectric/electrostrictive layer 79 generally has a thickness of not larger than 100 $\mu$m. The thickness of each of the electrode films 75, 77 is generally 20 $\mu$m or smaller, preferably 5 $\mu$m or smaller. To assure a relatively large amount of displacement by application of a relatively low voltage, the thickness of the piezoelectric/electrostrictive layer 79 is preferably 50 $\mu$m or smaller, more preferably, within a range of 3 $\mu$m to 40 $\mu$m.

Since the substrate of the piezoelectric/electrostrictive element 78 is constituted by the closure plate 66 formed of a material having partially stabilized zirconia as a major component, the element 78 exhibits sufficiently high degrees of mechanical strength and toughness even though the plate 66 has a relatively small thickness. At the same time, the thus formed piezoelectric/electrostrictive element 78 can provide a relatively large amount of displacement by application of a relatively low operating voltage, with a relatively large magnitude of force or electric potential generated, and has an improved operating response.

In addition, the film-forming method used for forming the electrode films 75, 77 and the piezoelectric/electrostrictive layer 79 permits a relatively large number of the piezoelectric/electrostrictive elements 78 to be formed on the closure plate 66 of the ink pump member 44. That is, in the film-forming process as described above, the elements 78 can be concurrently and easily formed with a minute spacing left between the adjacent ones, without using an adhesive or the like. Accordingly, a plurality of piezoelectric/electrostrictive elements 78 can be easily formed on appropriation portions of the ink pump member 44 which correspond to the respective ink chambers 46 formed therein.

After firing the above-described ink pump member 44 on which the piezoelectric/electrostrictive elements 78 are integrally formed, the ink pump member 44 is superposed on the above-described ink nozzle member 42, and these members 42, 44 are bonded together by a suitable adhesive, into an integral structure of the ink jet print head 40, as shown in FIG. 1. In the thus formed ink jet print head 40, the ink material which is led through the ink supply channel 62 is supplied to the ink chambers 46 through the respective orifices 58, and is passed through the through-holes 56, 57 and jetted outwards from the nozzles 54, based on the operation of the piezoelectric/electrostrictive elements 78 formed integrally on the ink pump member 44.

The adhesive used for bonding the ink pump member 44 and ink nozzle member 42 may be selected from various known adhesives containing any one of vinyl, acryl, polyamide, phenol, resorcinol, urea, melamine, polyester, epoxy, furan, polyurethane, silicone, rubber, polyimide and polyolefin, provided the selected adhesive is resistant to the ink material.

It is desirable in terms of production efficiency that the adhesive is in the form of a highly viscous paste which can be applied by coating using a dispenser, or by screen-printing, or is in the form of a sheet which permits punching thereof. It is more desirable to use a hot-melt type adhesive which requires a relatively short heating time, or an adhesive which is curable at room temperature. The adhesive in the form of a highly viscous paste may be obtained by mixing an adhesive material with a filler so as to increase the viscosity of the resulting adhesive.

In view of the durability with respect to an aqueous ink material, it is particularly preferable to use an elastic epoxy adhesive or silicone-contained adhesive which can be applied by screen-printing, or sheet-like, hot-melt type adhesive containing polyolefin or polyester, which permits punching thereof. It is also possible to apply various adhesives as indicated above to different portions of the bonding surfaces of the ink pump member 44 and/or the ink nozzle member 42.

Upon bonding of the ink pump member 44 and ink nozzle member 42 as described above, the ink chambers 46 formed in the ink pump member 44 are suitably held in communication with the nozzles 54 and the ink supply channel 62 formed in the ink nozzle member 42, with the first and second communication holes 72, 74 being in communication with the through-holes 56 and orifices 58 formed through the orifice plate 50 of the ink nozzle member 42, respectively.

To achieve sufficient fluid-tightness of the ink flow channel through which the ink flows in the print head 40, the seal between the bonding surfaces of the ink pump member 44 and the ink nozzle member 42 needs to be well established only at around the first and second communication holes 72, 74. This leads to a significantly reduced area of bonded portions which must provide a complete seal, permitting the ink flow channel to easily and surely assure excellent fluid-tightness.

In this particular embodiment, the diameters of the first and second communication holes 72, 74 are set to be smaller than the width dimension of the ink chamber 46 (the width dimension of the window 76 formed in the spacer plate 70). Therefore, the adjacent ones of the first communication holes 72 and those of the second communication holes 74 are spaced apart from each other by a sufficiently large distance (indicated by "L" in FIG. 2).

The above arrangement assures a sufficiently large area of bonding between the ink pump member 44 and the ink nozzle member 42, at around the respective first and second communication holes 72, 74. Accordingly, a further improved seal can be obtained at the bonding surfaces of the members 42, 44 even if these members 42, 44 are made of different kinds of materials.

Figure 7:
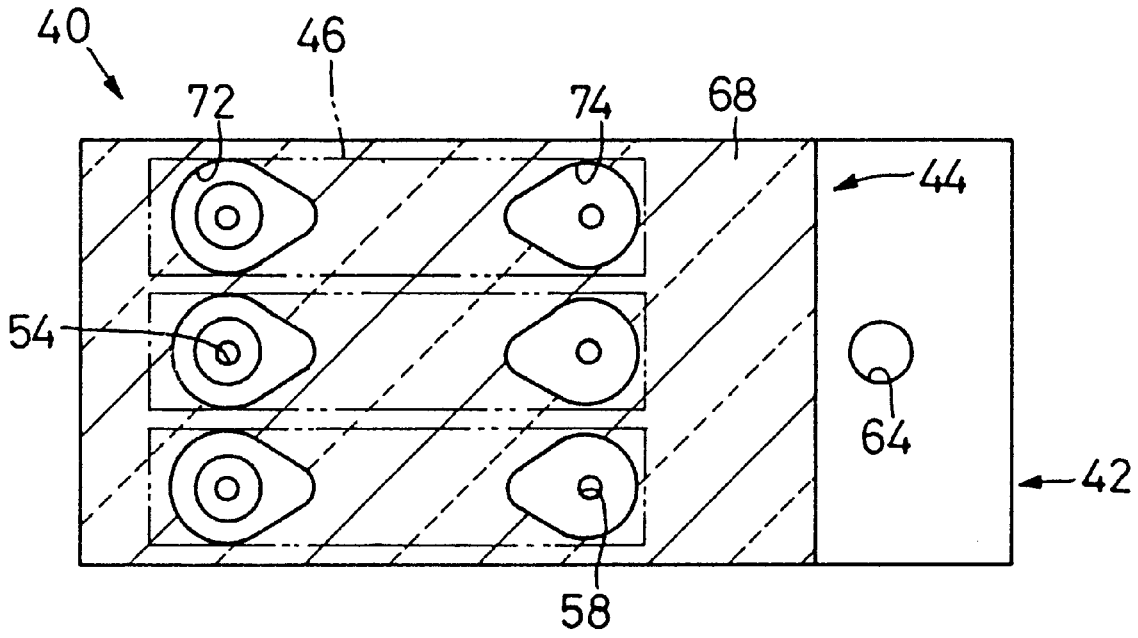
FIG. 7 is a cross sectional view corresponding to that of FIG. 2, showing a modification of first and second communication holes of the ink jet print head of FIG. 1.

Depending upon the kind of the adhesive used or the method of application of the adhesive, there is a possibility that the adhesive would overflow into the first and second communication holes 72, 74 to thereby close the openings of these holes 72, 74. In this case, it is desirable that the diameter of the first and second communication holes 72, 74 be set to be substantially equal to the width dimension of the corresponding ink chamber 46, so as to avoid the closure of the openings of the holes 72, 74. It is also desirable to form one or both of the first and second communication holes 72 in teardrop shape as shown in FIG. 7, or elliptic shape.

Figure 5:
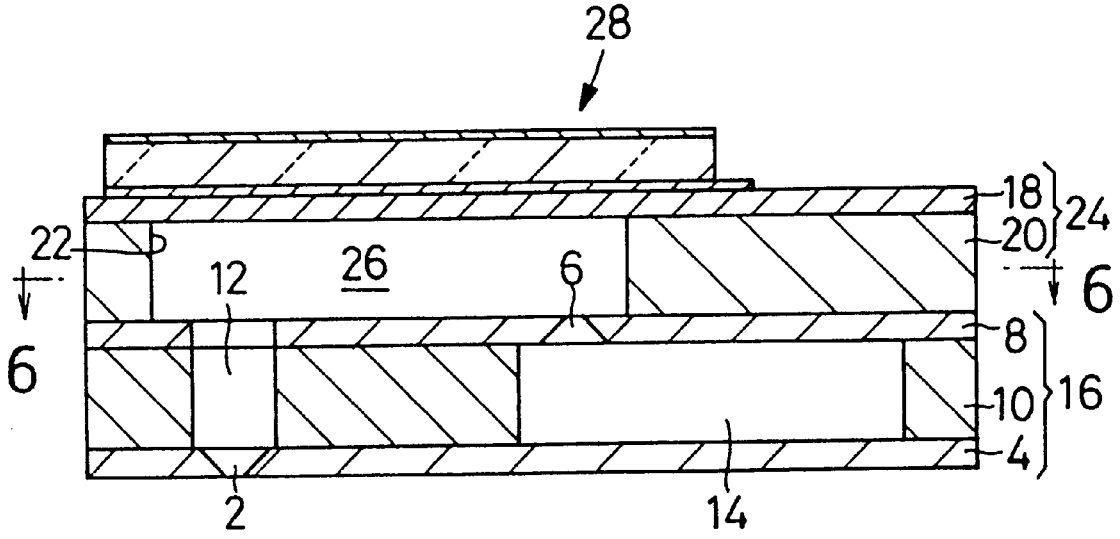
FIG. 5 PRIOR ART
FIG. 5 is a vertical cross sectional view showing one example of conventional ink jet print head.
Figure 6:
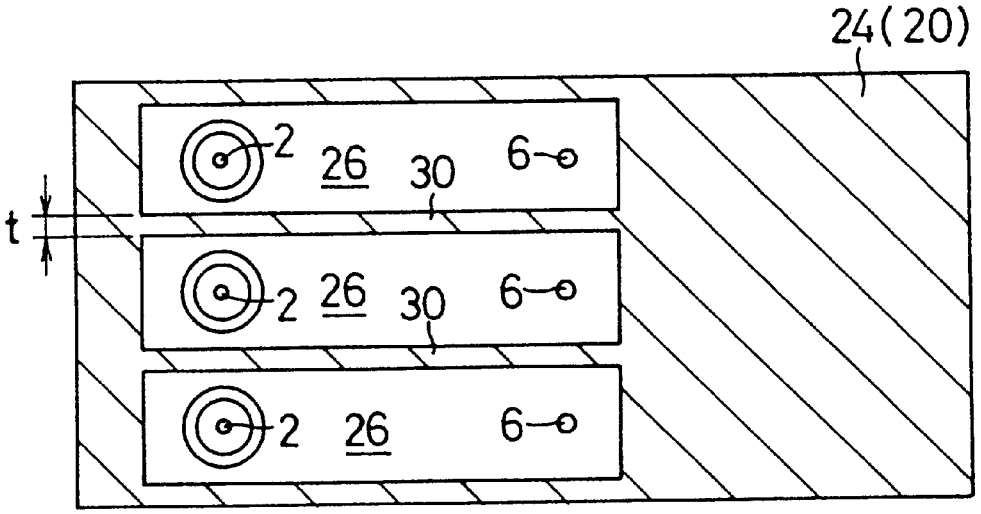
FIG. 6 PRIOR ART
FIG. 6 is a cross sectional view taken along line 6—6 of FIG. 5.

It will be easily understood by comparing the shapes of the bonding surfaces of the ink nozzle member 42 and the ink pump member 44 of the ink jet print head 40 of the instant embodiment, with those of the ink nozzle member 16 and the ink pump member 24 of the conventional ink jet print head as shown in FIGS. 5 and 6 that the print head 40 of the instant embodiment can achieve a significantly improved seal at the bonding surfaces of the members 42, 44, as compared with the conventional counterpart as shown in FIGS. 5 and 6.

Accordingly, the ink jet print head 40 can easily and stably assure sufficient sealing or fluid-tightness of the ink flow channel through which the ink flows, without suffering from the overflow of the adhesive into the ink chambers 46, and otherwise possible gaps formed between the bonding surfaces. Thus, the ink jet print head 40 exhibits significantly improved ink-jetting characteristics.

In producing the ink jet print head 40 as described above, a suitable film-forming method is employed to form the piezoelectric/electrostrictive elements 78 each of which is adapted to deform a portion of the closure member 66 which defines the corresponding ink chamber 46 to thereby change the internal pressure of the ink chamber 46. Therefore, the piezoelectric/electrostrictive elements 78 can be easily formed on the portions of the closure member 66 which correspond to the respective ink chambers 46, with high production efficiency, assuring excellent ink-jetting characteristics of the print head with high stability.

While the present invention has been described in its presently preferred embodiment with a certain degree of particularity, it is to be understood that the invention is not limited to the details of the illustrated embodiment, but may be otherwise embodied.

Figure 4:
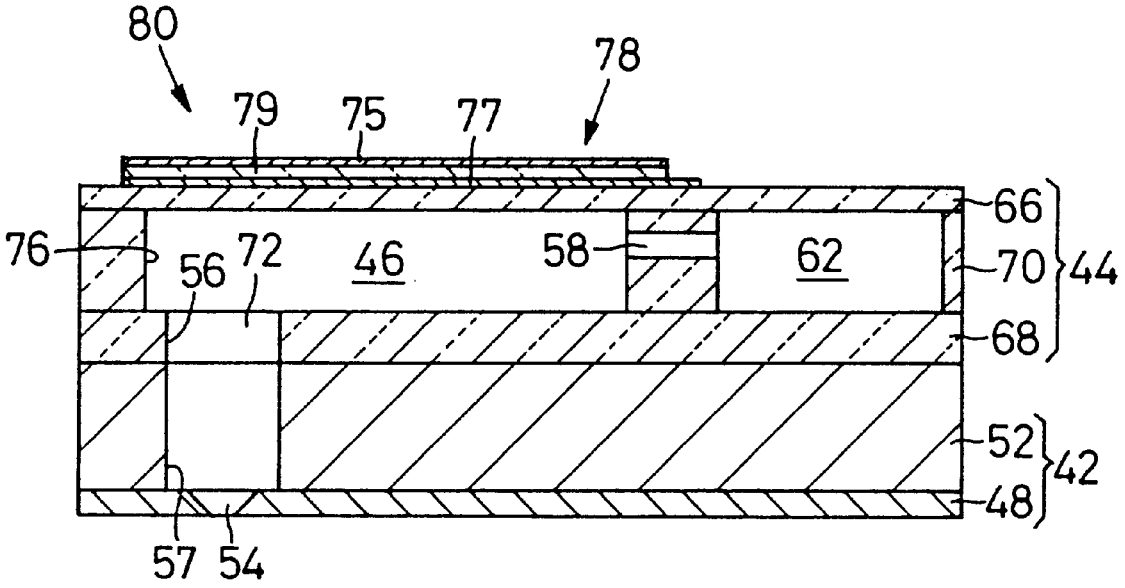
FIG. 4 is a vertical cross sectional view corresponding to that of FIG. 1, showing another embodiment of an ink jet print head of the present invention.

While the ink supply channel 62 through which the ink is fed into the ink chambers 46 is formed within the ink nozzle member 42 in the illustrated embodiment, the ink supply channel 62 may be formed within the ink pump member 44, as shown in FIG. 4 by way of example. In this figure, the same numerals as used in FIG. 1 showing the first embodiment are used for identifying structurally or functionally corresponding elements, so as to facilitate understanding of the embodiment of FIG. 4.

The structure and material of the ink nozzle member 42 are by no means limited to those of the illustrated embodiment. For instance, it is possible to form the whole or a part of the ink nozzle member 42 as an integral body, by injection molding using a synthetic resin material or the like, or any other molding technique.

Further, the position and number of the nozzles 54 and orifices 58 formed in the ink nozzle member 42, and the position and number of the ink chambers 46 formed in the ink pump member 44 are never limited to those of the illustrated embodiment, but may be suitably selected.

Moreover, the principle of the present invention is applicable to ink jet print heads of on-demand type or continuous jet type, and to these types of ink jet print heads having various structures.

It is also to be understood that the present invention may be embodied with various other changes, modifications and improvements, which may occur to those skilled in the art, without departing from the spirit and scope of the invention defined in the following claims.

What is claimed is:

1. An ink jet print head comprising:

an ink nozzle member having a plurality of nozzles through which fine particles of ink are jetted;

an ink pump member disposed on and bonded to said ink nozzle member, said ink pump member having a plurality of ink chambers formed behind the respective nozzles of said ink nozzle member, said ink pump member comprising a spacer plate having a plurality of windows which provide said ink chambers, respectively, a closure plate disposed on one of opposite major surfaces of said spacer plate remote from said ink nozzle member, for closing one of opposite openings of each of said windows, and a connecting plate disposed on the other of said opposite major surfaces of said spacer plate, for closing the other of said opposite openings of said each of said windows, said connecting plate having a plurality of first communication holes located behind the respective nozzles of said ink nozzle member, for communicating said ink chambers with the nozzles; said spacer plate, said closure plate and said connecting plate being formed from ceramic green sheets which are laminated on each other and fired into an integral ceramic structure as said ink pump member; and a plurality of piezoelectric/electrostrictive elements each disposed on a wall partially defining the corresponding one of said ink chambers, for deforming said wall so as to change a pressure of the corresponding ink chamber, whereby the ink in the ink chamber is jetted through the corresponding one of said plurality of nozzles, each of said piezoelectric/electrostrictive elements comprising a piezoelectric/electrostrictive unit consisting of a pair of electrodes and a piezoelectric/electrostrictive layer, which are formed by a film-forming method on an outer surface of said closure plate of said ink pump member, such that said piezoelectric/electrostrictive layer is interposed between said pair of electrodes, wherein said ink nozzle member has an ink supply channel through which the ink is fed to said ink chambers of said ink pump member, and a plurality of orifices for guiding the ink from said ink supply channel to the respective ink chambers, said orifices being open on an outer surface of the ink nozzle member on which the ink pump member is superposed, said connecting plate of the ink pump member having a plurality of second communication holes located adjacent the respective orifices of the ink nozzle member, said second communication holes communicating the ink chambers with the respective orifices.

2. An ink jet print head as defined in claim 1, wherein said first and second communication holes have a diameter which is smaller than a width dimension of each of said ink chambers.

3. An ink jet print head as defined in claim 1, wherein said ink nozzle member consists of a nozzle plate having said plurality of nozzles, a channel plate having a window formed therethrough, and an orifice plate having said plurality of orifices, said window of said channel plate being closed by said nozzle plate and said orifice plate so as to form said ink supply channel within said ink nozzle member.

4. An ink jet print head as defined in claim 3, wherein said orifice plate further has a supply port through which the ink is supplied to said ink supply channel.

5. An ink jet print head as defined in claim 3, wherein said orifice plate has a plurality of first through-holes communicating with said first communication holes of said connecting plate, respectively, and said channel plate has a plurality of second through-holes communicating with said nozzles of said nozzle plate, respectively, said first through-holes being held in communication with said second through-holes, said ink chambers communicating with the respective nozzles through the first communication holes and the first and second through-holes.

6. An ink jet print head as defined in claim 5, wherein said first and second through-holes have a diameter which is larger than a diameter of said nozzles.

7. An ink jet print head as defined in claim 1, wherein said ink pump member is comprises of alumina or zirconia.

8. An ink jet print head as defined in claim 1, wherein said connecting plate of said ink pump member has a thickness of not smaller than 10 $\mu$m.

9. An ink jet print head as defined in claim 1, wherein said spacer plate of said ink pump member has a thickness of not smaller than 50 $\mu$m.

10. An ink jet print head as defined in claim 1, wherein said closure plate is comprised of a ceramic material containing partially or fully stabilized zirconia as a major component.

11. An ink jet print head as defined in claim 1, wherein said film-forming method for forming said electrodes and said piezoelectric/electrostrictive layer is selected from the group consisting of: screen printing, spraying, dipping, coating, ion-beam method, sputtering, vacuum vapor deposition, ion plating, CVD and plating.

12. An ink jet print head comprising:

an ink nozzle member having a plurality of nozzles through which fine particles of ink are jetted;

an ink pump member disposed on and bonded to said ink nozzle member, said ink pump member having a plurality of ink chambers formed behind the respective nozzles of said ink nozzle member, said ink pump member comprising a spacer plate having a plurality of windows which provide said ink chambers, respectively, a closure plate disposed on one of opposite major surfaces of said spacer plate remote from said ink nozzle member, for closing one of opposite openings of each of said windows, and a connecting plate disposed on the other of said opposite major surfaces of said spacer plate, for closing the other of said opposite openings of said each of said windows, said connecting plate having a plurality of first communication holes located behind the respective nozzles of said ink nozzle member, for communicating said ink chambers with the nozzles; said spacer plate, said closure plate and said connecting plate being formed from ceramic green sheets which are laminated on each other and fired into an integral ceramic structure as said ink pump member; said closure plate having a thickness of not larger than 50 $\mu$m; and a plurality of piezoelectric/electrostrictive elements each disposed on a wall partially defining the corresponding one of said ink chambers, for deforming said wall so as to change a pressure of the corresponding ink chamber, whereby the ink in the ink chamber is jetted through the corresponding one of said plurality of nozzles, each of said piezoelectric/electrostrictive elements comprising a piezoelectric/electrostrictive unit consisting of a pair of electrodes and a piezoelectric/electrostrictive layer, which are formed by a film-forming method on an outer surface of said closure plate of said ink pump member, such that said piezoelectric/electrostrictive layer is interposed between said pair of electrodes.

13. An ink jet print head as defined in claim 12, wherein said ink pump member is comprised of alumina or zirconia.

14. An ink jet print head as defined in claim 12, wherein said connecting plate of said ink pump member has a thickness of not smaller than 10 $\mu$m.

15. An ink jet print head as defined in claim 12, wherein said spacer plate of said ink pump member has a thickness of not smaller than 50 $\mu$m.

16. An ink jet print head as defined in claim 12, wherein said closure plate is comprised of a ceramic material containing partially or fully stabilized zirconia as a major component.

17. An ink jet print head as defined in claim 12, wherein said film-forming method for forming said electrodes and said piezoelectric/electrostrictive layer is selected from the group consisting of: screen printing, spraying, dipping, coating, ion-beam method, sputtering, vacuum vapor deposition, ion plating, CVD and plating.

18. An ink jet print head comprising:

an ink nozzle member having a plurality of nozzles through which fine particles of ink are jetted;

an ink pump member disposed on and bonded to said ink nozzle member, said ink pump member having a plurality of ink chambers formed behind the respective nozzles of said ink nozzle member, said ink pump member comprising a spacer plate having a plurality of windows which provide said ink chambers, respectively, a closure plate disposed on one of opposite major surfaces of said spacer plate remote from said ink nozzle member, for closing one of opposite openings of each of said windows, and a connecting plate disposed on the other of said opposite major surfaces of said spacer plate, for closing the other of said opposite openings of said each of said windows, said connecting plate having a plurality of first communication holes located behind the respective nozzles of said ink nozzle member, for communicating said ink chambers with the nozzles; said spacer plate, said closure plate and said connecting plate being formed from ceramic green sheets which are laminated on each other and fired into an integral ceramic structure as said ink pump member; and a plurality of piezoelectric/electrostrictive elements each disposed on a wall partially defining the corresponding one of said ink chambers, for deforming said wall so as to change a pressure of the corresponding ink chamber, whereby the ink in the ink chamber is jetted through the corresponding one of said plurality of nozzles, each of said piezoelectric/electrostrictive elements comprising a piezoelectric/electrostrictive unit consisting of a pair of electrodes and a piezoelectric/electrostrictive layer, which are formed by a film-forming method on an outer surface of said closure plate of said ink pump member, such that said piezoelectric/electrostrictive layer is interposed between said pair of electrodes, wherein an outer surface of said connecting plate to which said ink nozzle member is bonded has a maximum waviness of not larger than 50 $\mu$m as measured along a reference length of 8 mm.

* * * * *